US006676391B2

(12) United States Patent
Koo et al.

(10) Patent No.: US 6,676,391 B2
(45) Date of Patent: Jan. 13, 2004

(54) VARIABLE QUANTITY CONTROL APPARATUS FOR VARIABLE RADIUS TYPE SCROLL COMPRESSOR

(75) Inventors: In Hwe Koo, Seongnam (KR); Yang Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 10/041,572

(22) Filed: Jan. 10, 2002

(65) Prior Publication Data

US 2003/0039570 A1 Feb. 27, 2003

(30) Foreign Application Priority Data

Aug. 22, 2001 (KR) ..... 2001-50756

(51) Int. Cl.[7] ..... F04C 18/00
(52) U.S. Cl. ..... 418/55.5; 418/57
(58) Field of Search ..... 418/55.5, 57

(56) References Cited

U.S. PATENT DOCUMENTS 5,174,739 A * 12/1992 Kim ..... 418/55.5
5,520,527 A * 5/1996 Kim ..... 418/55.5
5,779,461 A * 7/1998 Iizuka et al. ..... 418/55.5
6,106,251 A * 8/2000 Monnier et al. ..... 418/55.5

FOREIGN PATENT DOCUMENTS

JP 05248371 A * 9/1993 ..... F04C/18/02

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

A variable quantity control apparatus for a variable radius type scroll compressor comprises: a rotary shaft coupled to an orbiting scroll for transmitting a rotating force of a driving motor to the orbiting scroll; and an eccentric bushing coupled to a driving pin part of the rotary shaft for transmitting the rotating force of the driving motor and at the same time, for restraining a recession amount of the orbiting scroll, whereby manufacturing cost can be reduced because an additional stopper member can be excluded and the number of components and the number of assembling processes are reduced, and the recession of the eccentric bushing (or the orbiting scroll) can be stably restrained by the surface contacting of a cut surface of the rotary shaft and stopping surfaces of the eccentric bushing.

7 Claims, 4 Drawing Sheets

VARIABLE QUANTITY CONTROL APPARATUS FOR VARIABLE RADIUS TYPE SCROLL COMPRESSOR

BACKGROUND OF THE INVENTION

1. Field of the Invention

The present invention relates to a variable quantity control apparatus for a variable radius type scroll compressor, and particularly, to a variable quantity control apparatus for a variable radius type scroll compressor by which a recession amount of an orbiting scroll can be effectively restrained, and also the number of components and assembling processes can be reduced.

2. Description of the Background Art

Generally, a scroll compressor is divided into a fixed radius type scroll compressor in which an orbiting scroll always orbits in an identical trajectory regardless of changes in compressing conditions, and a variable radius type scroll compressor in which an orbiting scroll is recessed with respect to a radial direction in order to prevent a wrap from being damaged when liquid refrigerant, oil, or impurity is inputted into a compression chamber and therefore a pressure in the compression chamber is increased abnormally.

In order to change an orbiting radius of the orbiting scroll in the variable radius type scroll compressor, a bushing, a slide block, or an eccentric bushing may be connected between a rotary shaft and the orbiting scroll.

The present invention is related to the variable radius type scroll compressor in which the eccentric bushing is connected.

As shown in FIG. 1, a conventional variable quantity control apparatus for the variable radius type scroll compressor includes a fixed scroll 2 including a spiral wrap 2*a* fixed on a main frame 1; an orbiting scroll 3 including a spiral wrap 3*a* engaged with the wrap 2*a* of the fixed scroll 2 and disposed between the main frame 1 and the fixed scroll 2; a rotary shaft 4 coupled to a driving motor and to the orbiting scroll so that a rotating force of the driving motor (not shown) can be transmitted to the orbiting scroll 3; and an eccentric bushing 5 inserted into the rotary shaft 4 for transmitting the rotating force of the driving motor to the orbiting scroll 3 and for inducing the orbiting scroll to be recessed when over-compressed.

A driving pin part 4*a* for transmitting the rotating force generated from the driving motor to the orbiting scroll 3 by inserting the eccentric bushing 5 is eccentrically protruded toward the main frame 1 on a front end surface of the rotary shaft 4, and a pin recess (not shown) in which a lower end of a stopper pin which will be described later is depressed toward opposite direction with a predetermined gap to the driving pin part 4*a*.

In addition, the eccentric bushing 5 includes a pin hole 5*a*, in which the driving pin part 4*a* of the rotary shaft 4 is inserted, formed on one side, and a pin recess 5*b*, in which the stopper pin 6 is inserted, formed with a certain gap with the pin hole 5*a*.

In addition, an upper half part of the stopper pin 6 is inserted and coupled to the eccentric bushing 5, and a lower half part of the stopper pin 6 is inserted into the pin recess (not shown) disposed on the front end surface of the rotary shaft 4 so as to be rotated to a circumferential direction of the rotary shaft.

And a driving bush 7 is coupled between an outer circumferential surface of the eccentric bushing 5 and an inner circumferential surface of a boss part 3*b* formed on lower end part of the main frame 1 for transmitting the driving force of the rotary shaft 4 to the main frame 1.

Unexplained reference numeral 2*b* designates a discharge hole, 2*c* designates a suction hole, and P designates a compression space.

Hereinafter, operations of the conventional variable quantity control apparatus for the variable radius type scroll compressor will be described as follows.

When the driving motor (not shown) is rotated with the rotary shaft 4 by the applied electric power, the orbiting scroll 3 is orbited over an eccentric distance, and accordingly, a plurality of compression spaces P are formed between the wrap 3*a* of the orbiting scroll 3 and the wrap 2*a* of the fixed scroll 2. And the compression spaces P are moved toward a center part by continued orbiting movements of the orbiting scroll 3. A volume of the space is gradually decreased and therefore refrigerant gas is drawn in, compressed and discharged.

At that time, in case that the refrigerant gas drawn in into the compression spaces maintains a normal state, the wrap 3*a* of the orbiting scroll 3 and the wrap 2*a* of the fixed scroll 2 are line contacted with each other, and then the both compression chambers form sealed spaces and locations of the eccentric bushing 5 and the stopper pin 6 are maintained.

On the contrary, if liquid refrigerant, oil, or other impurity in excess of a predetermined amount is mixed in the refrigerant gas which is sucked into the compression space P, the pressure in the compression space P is abnormally increased and the orbiting scroll 3 is likely to recess or rotated in reverse. In addition, this inclination is transmitted to the eccentric bushing 5 which is inserted into the boss part 3*b* of the orbiting scroll 3, and then the eccentric bushing 5 is rotated to the reverse direction of the orbiting scroll's direction. And during that process, as shown in FIG. 3, the wrap 3*a* of the orbiting scroll 3 and the wrap 2*a* of the fixed scroll 2 are separated from each other and the compression gas in the compression space of high pressure HP is leaked to the compression space of low pressure LP. Accordingly, damage of the wraps 2*a* and 3*a* by over-compression can be prevented.

However, in the conventional variable quantity control apparatus for the variable radius type scroll compressor described above, an additional stopper pin 6 should be made and post-assembled, and therefore the numbers of components and the assembling processes are increased and manufacturing cost is increased.

Also, the stopper pin 6 restricts the recession of the orbiting scroll 3 by line contacting the respective pin recesses (not shown) (5*b*) of the rotary shaft 4 and of the eccentric bushing 5. However, the contact area is small, and therefore there is the recess amount of the orbiting scroll 3 is restricted.

Also, when repeated recess mechanisms are performed, the stopper pin 6 has a weak mechanism resistance due to the limitation of the shape.

SUMMARY OF THE INVENTION

Therefore, an object of the present invention is to provide a variable quantity control apparatus for a variable radius type scroll compressor by which the number of components and the number of assembling processes are decreased, and therefore manufacturing cost can be reduced.

Also, another object of the present invention is to provide a variable quantity control apparatus for a variable radius type scroll compressor by which a recess quantity of an orbiting scroll can be stably restricted.

Also, still another object of the present invention is to provide a variable quantity control apparatus for a variable radius type scroll compressor which has strong mechanical resistance even if repeated recess mechanisms are applied.

To achieve these and other advantages and in accordance with the purpose of the present invention, as embodied and broadly described herein, there is provided a variable quantity control apparatus for a variable radius type scroll compressor comprising: a rotary shaft coupled to an orbiting scroll for transmitting a rotating force of a driving motor to the orbiting scroll; and an eccentric bushing coupled to a driving pin part of the rotary shaft for transmitting the rotating force of the driving motor to the orbiting scroll and restricting a recess amount of the orbiting scroll.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
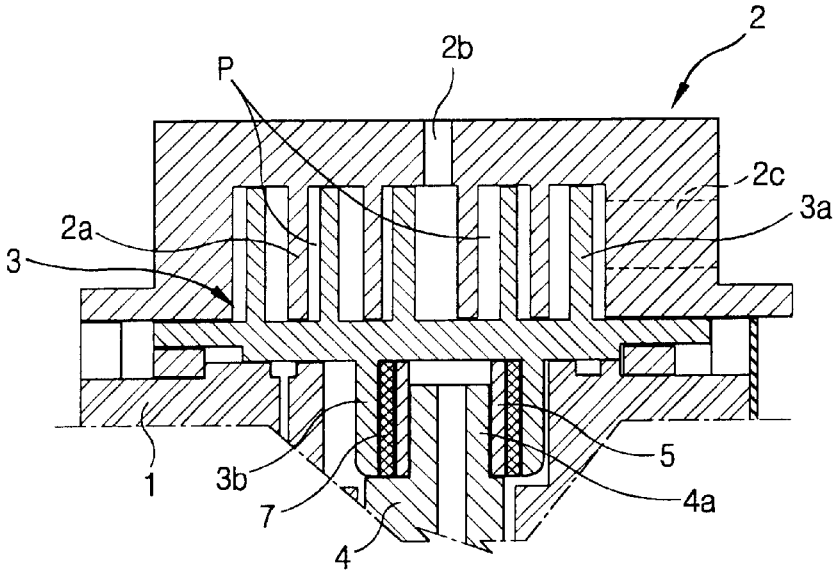
FIG.1 CONVENTIONAL ART
FIG. 1 is a partially longitudinal cross sectional view showing an example of a conventional variable radius type scroll compressor.
Figure 2:
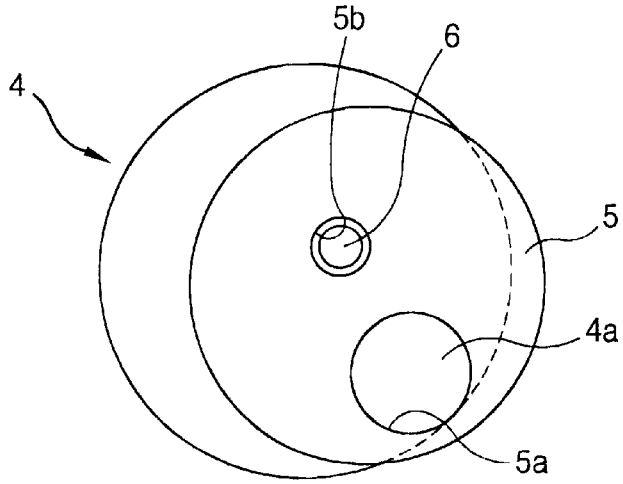
FIG.2 CONVENTIONAL ART
FIG. 2 is a plan view showing an assembled state of an eccentric bushing in the conventional variable radius type scroll compressor.

Reference will now be made in detail to the preferred embodiments of the present invention, examples of which are illustrated in the accompanying drawings.

For components same as in the conventional art, same reference numerals are used and descriptions are omitted.

Figure 4:
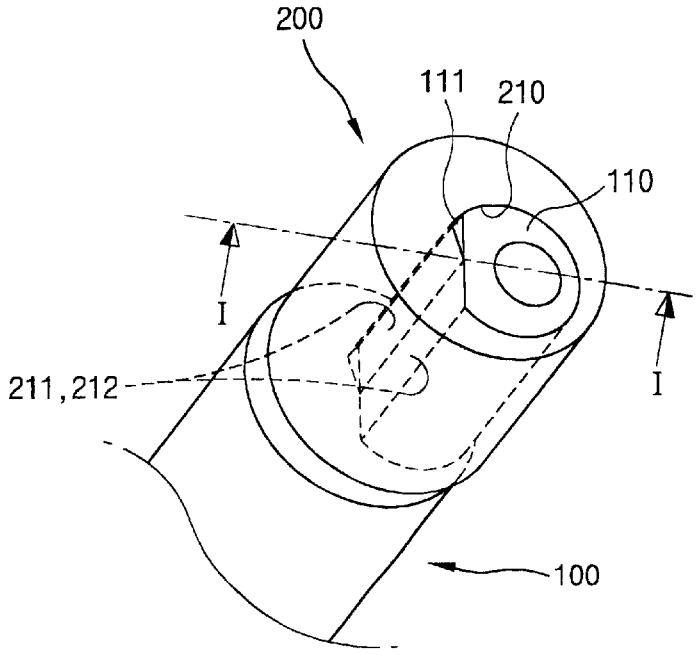
FIG. 4 is a perspective view showing a variable quantity control apparatus for a variable radius type scroll compressor according to the present invention.
Figure 5:
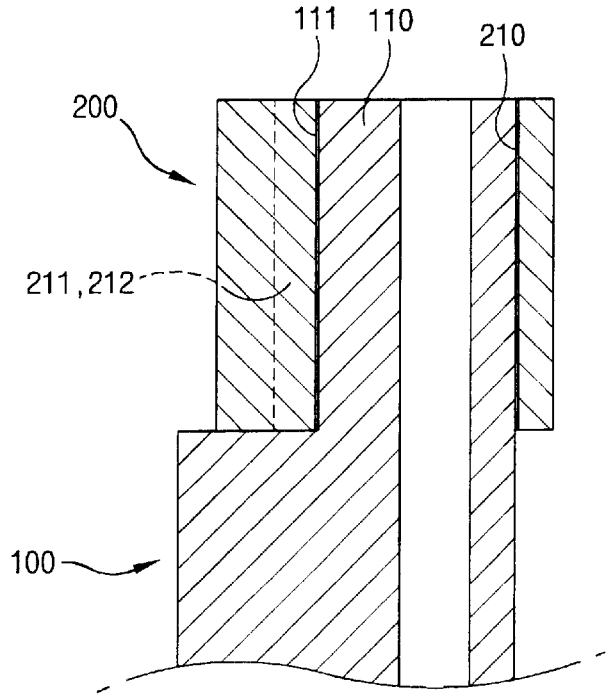
FIG. 5 is a cross sectional view showing line I—I in FIG. 4.
Figure 6:
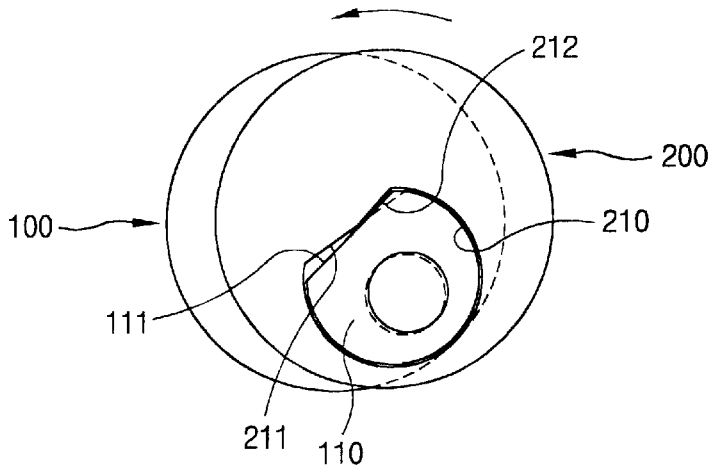
FIG. 6 is a plan view showing assembled state of an eccentric bushing in the variable radius type scroll compressor according to the present invention.
Figure 7:
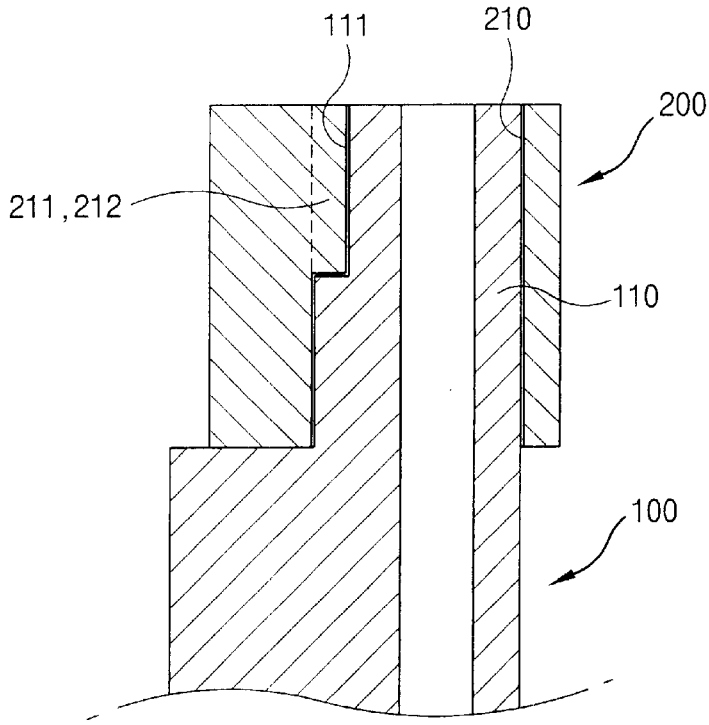
FIG. 7 is a longitudinal cross sectional view showing another example for the variable quantity control apparatus of the variable radius type scroll compressor according to the present invention.
Figure 8:
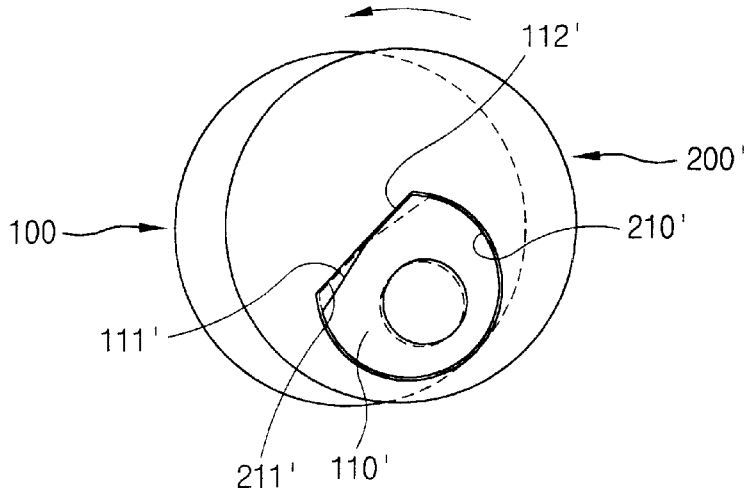
FIG. 8 is a plan view showing another example for the variable quantity control apparatus of the variable radius type scroll compressor according to the present invention.

FIG. 4 is a perspective view showing a variable quantity control apparatus for a variable radius type scroll compressor according to the present invention, FIG. 5 is a cross-sectional view of line I—I in FIG. 4, FIG. 6 is a plan view showing an assembled state of an eccentric bushing in the variable radius type scroll compressor according to the present invention, and FIGS. 7 and 8 are longitudinal cross sectional views showing another examples for the variable quantity control apparatus of the variable radius type scroll compressor according to the present invention.

As shown in FIG. 4, the variable quantity control apparatus for the variable radius type scroll compressor according to the present invention includes a rotary shaft 100 coupled to an orbiting scroll 3 (shown in FIG. 1) for transmitting a rotating force of a driving motor (not shown) to the orbiting scroll 3; and an eccentric bushing 200 coupled to a driving pin part 110 of the rotary shaft 100 for transmitting the rotating force of the driving motor to the orbiting scroll 3, and at the same time, for restricting a recess amount of the orbiting scroll.

The rotary shaft 100 is supported by a through hole (not defined by a reference numeral) on the main frame 1. A driving pin portion or part 110 for eccentrically rotating the orbiting scroll 3 is formed on an upper front end surface of the rotary shaft 100 to be eccentric from the shaft center of the rotary shaft 100. It is desirable that the driving pin part 110 is formed so that the center of the driving pin part 110 is located as far as possible from the shaft center of the rotary shaft 100 for safe driving by increasing the thickness of the pin.

In addition, the driving pin part 110 includes a cut surface 111 so as to surface contact with stopping surfaces 211 and 212 of an eccentric bushing 200 which will be described later on one side, and at that time, cross section of the entire driving pin part 110 is formed to have "D" shape.

In addition, a driving pin coupling hole 210 through which the driving pin part 110 of the rotary shaft 100 is slidingly inserted and having a diameter of the driving pin coupling hole 210 which is nearly similar to that of the rotary shaft 100 is eccentrically formed on the shaft center of the rotary shaft 100.

The driving pin coupling hole 210 includes a plurality of stopping surfaces 211 and 212 on positions of an inner circumferential surface corresponding to the cut surface 111 of the driving pin part 110. In addition, it is desirable that the stopping surfaces 211 and 212 are formed as wedges so that an intermediate part is protruded inward in radial direction when plan projected in order to transmit the rotating force of the rotary shaft or restrict the recess amount of the orbiting scroll 3 in a state of line contacting the cut surface 111 of the driving pin part 110.

Also, as shown in FIG. 7, the cut surface 111 may be formed only on the upper half part of the driving pin part 110, and the stopping surfaces 211 and 212 corresponding to the cut surface 111 may be formed on upper half part of the inner circumferential surface of the eccentric bushing 200. And it is effective to reduce stress concentration of the driving pin part 110 which may be generated when the rotating force of the rotary shaft 100 is transmitted to the orbiting scroll 3.

Hereinafter, operation and effect of the variable quantity control apparatus for the variable radius type scroll compressor according to the present invention will be described as follows.

To begin with, when an electric source is applied to the driving motor (not shown) and the rotary shaft 100 is rotated, the orbiting scroll 3 which is eccentrically coupled to the rotary shaft 100 orbits along with a predetermined trajectory, and the compression space P formed between the wrap 3*a* of the orbiting scroll 3 and the wrap 2*a* of the fixed scroll 2 during the process is moved to the center of the orbiting operation, and therefore the volume is reduced, accordingly the refrigerant gas is sucked, compressed, and discharged.

At that time, in case that the refrigerant gas induced into the compression space P maintains a normal condition, the eccentric bushing 200 is eccentrically rotated by a centrifugal force centering around the driving pin part 110 of the rotary shaft 100, and therefore the orbiting scroll 3 is orbited. Thereby, the wrap 3*a* of the orbiting scroll 3 and the wrap 2*a* of the fixed scroll 2 are line contacted with each other, and therefore the compression spaces P which are formed on both sides centering around the shaft center form sealed spaces.

On the contrary, in case that liquid refrigerant, oil, or impurity is excess of a predetermined amount is mixed in the refrigerant gas sucked into the compression space P, the pressure in the compression space P is abnormally increased. In addition, as shown in FIG. 3, the orbiting scroll 3 is pushed by the pressure of the over-compressed gas inside the compression space P, and it is likely to be recessed along with the radial direction.

In addition, as shown in FIG. 6, the inclination of recession is transmitted to the eccentric bushing 200 which is inserted into the boss part 3*b* of the orbiting scroll 3, then one stopping surface 211 of the eccentric bushing 200 is reversely rotated, that is, to the opposite direction of the compressor rotating direction from a state of line contacting to the cut surface 111 of the driving pin part 110. Thereby, one stopping surface 212 of the eccentric bushing 200 is surface contacted to the cut surface 111 of the driving pin part 110. Therefore, the recession of the eccentric bushing is restrained.

At the same time, the wrap 3*a* of the orbiting scroll 3 withdrawals from the wrap 2*a* of the fixed scroll 2 a distance equivalent to the recessed distance of the eccentric bushing 200 with the orbiting scroll 3, and therefore the compression spaces P are opened.

Figure 3:
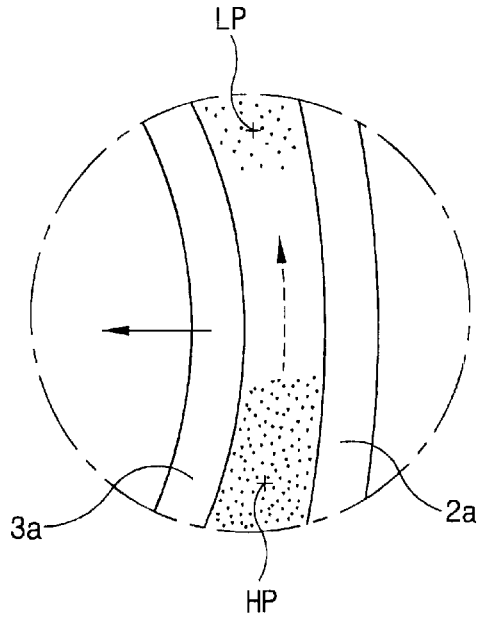
FIG.3 CONVENTIONAL ART
FIG. 3 is a sketch view showing changed state of a compression space when an orbiting scroll is recessed in the conventional variable radius type scroll compressor.

In addition, the compression gas is leaked between the opened compression spaces P, therefore the over-compressed refrigerant gas is moved from the compression space of high pressure (HP) to the compression space of lower pressure (LP), thereby over-compression in the compression space P is prevented, as shown in FIG. 3.

Therefore, an additional stopper member for controlling the recessed amount of the orbiting scroll 3 is not needed due to the stopping surfaces 211 and 212 formed on the eccentric bushing 200, and the manufacturing cost can be reduced by reducing the number of the components and the assembling processes.

Also, the cut surface 111 of the rotary shaft 100 and the stopping surfaces 211 and 212 of the eccentric bushing 200 are always in surface contact. The contact area is increased and the recessed amount of the eccentric bushing 200 is stably restrained, whereby the recession of the orbiting scroll when the compressor is over-compressed can be smoothly controlled.

On the other hand, as shown in FIG. 7, in case that the cut surface 111 is formed on upper half part of the driving pin part 110 and the stopping surfaces 211 and 212 are formed on the upper half part of the eccentric bushing 200, then the stress concentration on the starting end of the driving pin part 110 is reduced and the resistance of the rotary shaft 100 is improved.

Hereinafter, another embodiment for the variable quantity control apparatus for the variable radius type scroll compressor will be described as follows.

That is, in the previous embodiment, the cut surface 111 of a singular surface is formed on the driving pin part 110 of the rotary shaft 100 and the plurality of stopping surfaces 211 and 212 are formed on inner circumferential surface of the driving pin part coupling hole 210 on the eccentric bushing 200. However, in some cases, a plurality of cut surfaces 111' and 112' which are formed as wedges may be formed on outer side of the driving pin part 110' of the rotary shaft 100 in a radial direction, a stopping surface 211' of singular surface may be formed on a driving pin part coupling hole 210' of an eccentric bushing 200' so as to surface contact to the cut surfaces.

In above case, the operation and effect are same as those of the previous embodiment, and therefore descriptions for those are omitted.

Hereinafter, effects of the variable quantity control apparatus for the variable radius type scroll compressor according to the present invention will be described.

According to the variable quantity control apparatus for the variable radius type scroll compressor of the present invention, at least one cut surface is formed on an outer circumferential surface of the driving pin part, and more than two stopping surfaces for controlling recessed amount of the eccentric bushing by surface contacting to the cut surface of the driving pin part when the eccentric bushing recesses as performing angular movement with the orbiting scroll centering around the driving pin part are formed on an inner circumferential surface of the eccentric bushing, whereby the manufacturing cost can be reduced by reducing the number of components and the number of assembling processes, and the recessions of the eccentric bushing or the orbiting scroll can be stably restrained by surface contacting of the cut surface of the rotary shaft and the stopping surface of the eccentric bushing.

Also, the cut surface is formed only on the upper half part of the driving pin part and the stopping surface is formed only on the upper half part of the eccentric bushing, and therefore the stress concentration on the starting end of the driving pin part and the resistance can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A variable quantity control apparatus for a variable radius type scroll compressor comprising:

a rotary shaft coupled to an orbiting scroll for transmitting a rotating force of a driving motor to the orbiting scroll;

an eccentric bushing coupled to a driving pin portion of the rotary shaft for transmitting the rotating force of the driving motor to the orbiting scroll and concurrently restraining a recession amount of the orbiting scroll;

a cut surface being formed on an outer circumferential surface of the rotary shaft; and stopping surfaces being formed on an inner circumferential surface of the eccentric bushing, said stopping surfaces restraining the recession amount of the eccentric bushing by a surface contact to the cut surface of the driving pin portion when the eccentric bushing rotates through a range of angular movement coincident with the orbiting scroll centered around the driving pin portion.

2. The apparatus according to claim 1, wherein the cut surface and the stopping surfaces have cross-sections of different shapes from each other.

3. The apparatus according to claim 2, wherein the cut surface extends from a starting end to an operating end of the driving pin portion, and the stopping surfaces extend through both ends of the eccentric bushing.

4. The apparatus according to claim 2, wherein a part of the cut surface is formed along a shaft line direction of the rotary shaft, and the stopping surfaces are also formed on only a part of the eccentric bushing corresponding to the cut surface.

5. The apparatus according to claim 4, wherein the cut surface is formed as inclined toward an operating end of the driving pin portion.

6. The apparatus according to claim 1, wherein the cut surface is formed on one side of the outer circumferential surface of the driving pin portion as a singular surface, and the stopping surfaces protrude from the inner circumferential surface of the eccentric bushing to form a plurality of surfaces.

7. The apparatus according to claim 6, wherein a center part of the stopping surfaces remains in surface contact with the cut surface with respect to a shaft direction of the rotary shaft.

* * * * *